US008282506B1

(12) United States Patent
Holt

(10) Patent No.: US 8,282,506 B1
(45) Date of Patent: Oct. 9, 2012

(54) IRON-TYPE GOLF CLUB HEAD WITH REAR CAVITY WITH UNDERCUT

(75) Inventor: Denver Holt, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 280 days.

(21) Appl. No.: 12/875,294

(22) Filed: Sep. 3, 2010

Related U.S. Application Data

(60) Provisional application No. 61/243,852, filed on Sep. 18, 2009.

(51) Int. Cl.
*A63B 53/04* (2006.01)

(52) U.S. Cl. ..... 473/350; 473/328; 473/349

(58) Field of Classification Search ..... 473/349–350, 473/328, 324; D21/748, 749
See application file for complete search history.

(56) References Cited

U.S. PATENT DOCUMENTS

| | | | | | |
|---|---|---|---|---|---|
| 4,964,640 | A | * | 10/1990 | Nakanishi et al. | 473/335 |
| D328,628 | S | * | 8/1992 | Antonious | D21/748 |
| 5,437,456 | A | * | 8/1995 | Schmidt et al. | 473/291 |
| D371,182 | S | * | 6/1996 | Stites | D21/749 |
| 5,704,849 | A | | 1/1998 | Schmidt et al. | |
| 5,749,795 | A | * | 5/1998 | Schmidt et al. | 473/350 |
| 5,776,010 | A | | 7/1998 | Helmstetter et al. | |
| 5,921,869 | A | | 7/1999 | Blough et al. | |
| 5,971,868 | A | | 10/1999 | Kosmatka | |
| 6,015,354 | A | * | 1/2000 | Ahn et al. | 473/256 |
| 6,045,455 | A | | 4/2000 | Kosmatka | |
| 6,186,905 | B1 | | 2/2001 | Kosmatka | |
| 6,210,290 | B1 | | 4/2001 | Erickson et al. | |
| D454,932 | S | * | 3/2002 | Mahaffey et al. | D21/747 |
| 6,695,937 | B1 | * | 2/2004 | Stites, III | 148/577 |
| 6,709,345 | B2 | * | 3/2004 | Iwata et al. | 473/291 |
| 6,719,641 | B2 | * | 4/2004 | Dabbs et al. | 473/291 |
| 6,777,640 | B2 | * | 8/2004 | Takeda | 219/121.64 |
| 6,921,344 | B2 | * | 7/2005 | Gilbert et al. | 473/334 |
| D508,722 | S | * | 8/2005 | Iwata et al. | D21/759 |
| 7,022,028 | B2 | * | 4/2006 | Nagai et al. | 473/291 |
| 7,077,763 | B2 | * | 7/2006 | Wahl et al. | 473/334 |
| 7,083,531 | B2 | | 8/2006 | Aguinaldo et al. | |
| 7,112,148 | B2 | | 9/2006 | Deshmukh | |
| 7,131,913 | B2 | * | 11/2006 | Iwata et al. | 473/350 |
| 7,144,336 | B2 | | 12/2006 | Reyes et al. | |
| 7,186,188 | B2 | * | 3/2007 | Gilbert et al. | 473/290 |
| 7,192,362 | B2 | * | 3/2007 | Gilbert et al. | 473/291 |
| D552,703 | S | * | 10/2007 | Iwata et al. | D21/759 |
| 7,326,126 | B2 | | 2/2008 | Holt et al. | |
| 7,338,387 | B2 | | 3/2008 | Nycum et al. | |
| 7,338,389 | B2 | | 3/2008 | Wieland et al. | |
| 7,341,503 | B2 | * | 3/2008 | Huang | 451/54 |
| 7,731,604 | B2 | * | 6/2010 | Wahl et al. | 473/337 |
| 7,789,772 | B2 | * | 9/2010 | Sukman | 473/334 |
| 7,901,298 | B2 | * | 3/2011 | Sukman | 473/334 |
| 8,043,165 | B2 | * | 10/2011 | Galloway | 473/328 |
| 8,216,088 | B2 | * | 7/2012 | Hatton et al. | 473/335 |

* cited by examiner

*Primary Examiner* — Stephen L. Blau
(74) *Attorney, Agent, or Firm* — Michael A. Catania; Rebecca Hanovice; Sonia Lari

(57) ABSTRACT

An iron-type golf club head having a rear cavity with an undercut portion is disclosed herein. The undercut portion is present in less than 360 degrees of the rear cavity. Further, the undercut portion is preferably discontinuous. Further, the under portion preferably has sharp angles at segments of the rear cavity.

7 Claims, 10 Drawing Sheets

$$\text{Undercut Angle} = \frac{\sum \theta_n}{360} \quad ; \theta_n = \text{angles subtending undercutsegments}$$

undercut angle 610
Included angle 6 sided 720 deg

IRON-TYPE GOLF CLUB HEAD WITH REAR CAVITY WITH UNDERCUT

CROSS REFERENCES TO RELATED APPLICATIONS

The present application claims priority to U.S. Provisional Patent Application No. 61/243,852, filed on Sep. 18, 2009, which is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head. More specifically, the present invention relates to an iron-type golf club head having a rear cavity with an undercut portion.

2. Description of the Related Art

The prior art discloses iron-type golf club heads with undercuts.

Callaway Golf Company has sold iron-type golf club heads with a rear cavity having an undercut under the following product names: BIG BERTHA® irons; X-12® irons; HAWKEYE® irons; X-14® irons; X-16® irons; X-18® irons; X-20™ irons; X-22™ irons and others.

BRIEF SUMMARY OF THE INVENTION

The present invention is an iron-type golf club head with a rear cavity having an undercut.

One aspect of the present invention is an iron-type golf club head comprising a body having a rear cavity with a non-continuous undercut portion.

Another aspect of the present invention is an iron-type golf club head comprising a body having a rear cavity with a sharp angle undercut portion.

Another aspect of the present invention is an iron-type golf club head comprising a body having a rear cavity with a non-curved undercut portion.

Another aspect of the present invention is an iron-type golf club head comprising a body having a rear cavity that is segmented into six straight sections.

Another aspect of the present invention is an iron-type golf club head comprising a body having a rear cavity with at least five sections of the six sections that have an undercut portion.

Another aspect of the present invention is an iron-type golf club head comprising a body having a rear cavity with at least four sections of the six sections that have an undercut portion.

Another aspect of the present invention is an iron-type golf club head comprising a body having a rear cavity with an undercut portion of 295 degrees, wherein a total perimeter of a rear cavity is 7.8 inches and an undercut portion is present along 5.8 inches of the total perimeter.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
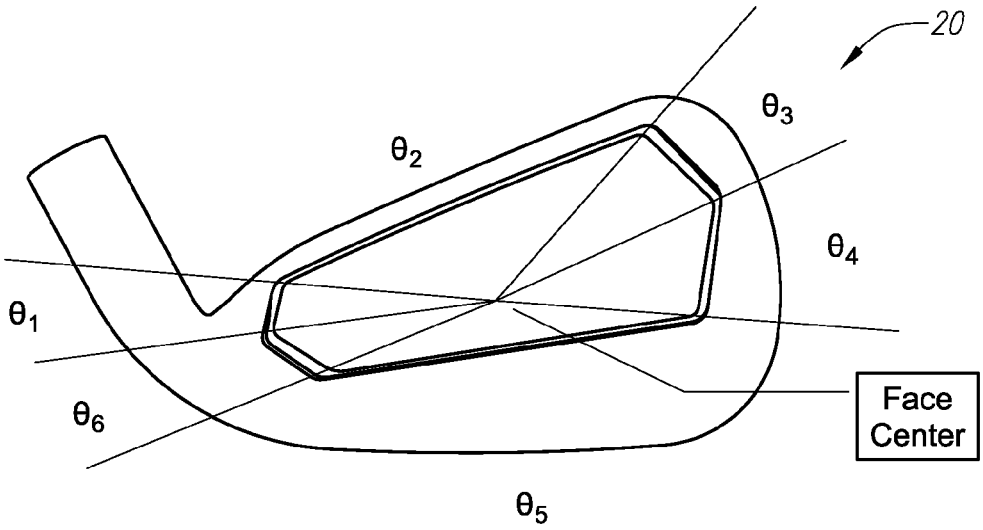
FIG. 1 is a back view of an iron-type golf club head illustrating angle partitions for an undercut in a rear cavity.
Figure 2:
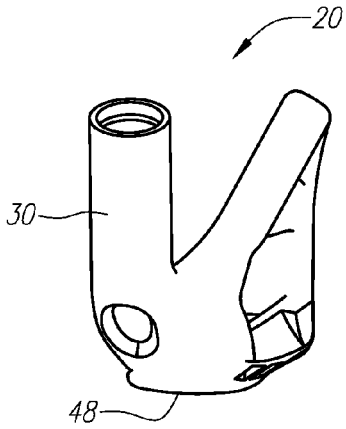
FIG. 2 is a heel side view of an iron-type golf club head.
Figure 3:
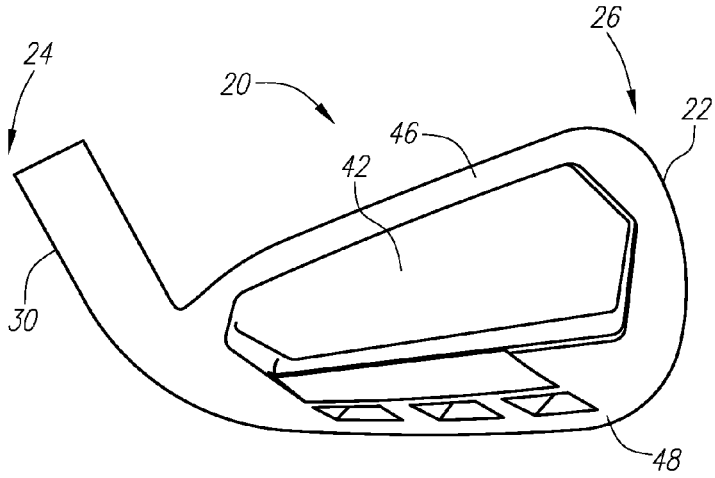
FIG. 3 is a rear view of an iron-type golf club head.
Figure 4:
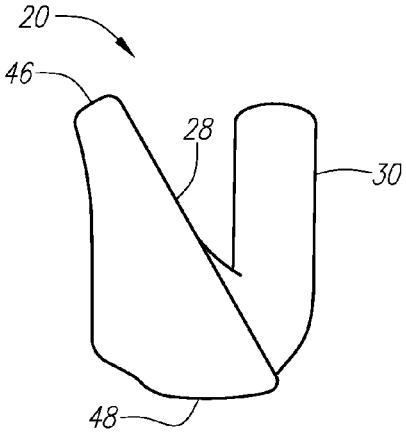
FIG. 4 is a toe side view of an iron-type golf club head.
Figure 5:
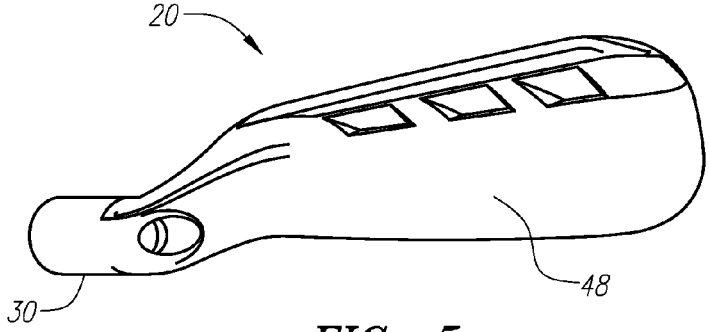
FIG. 5 is a bottom plan view of an iron-type golf club head.
Figure 6:
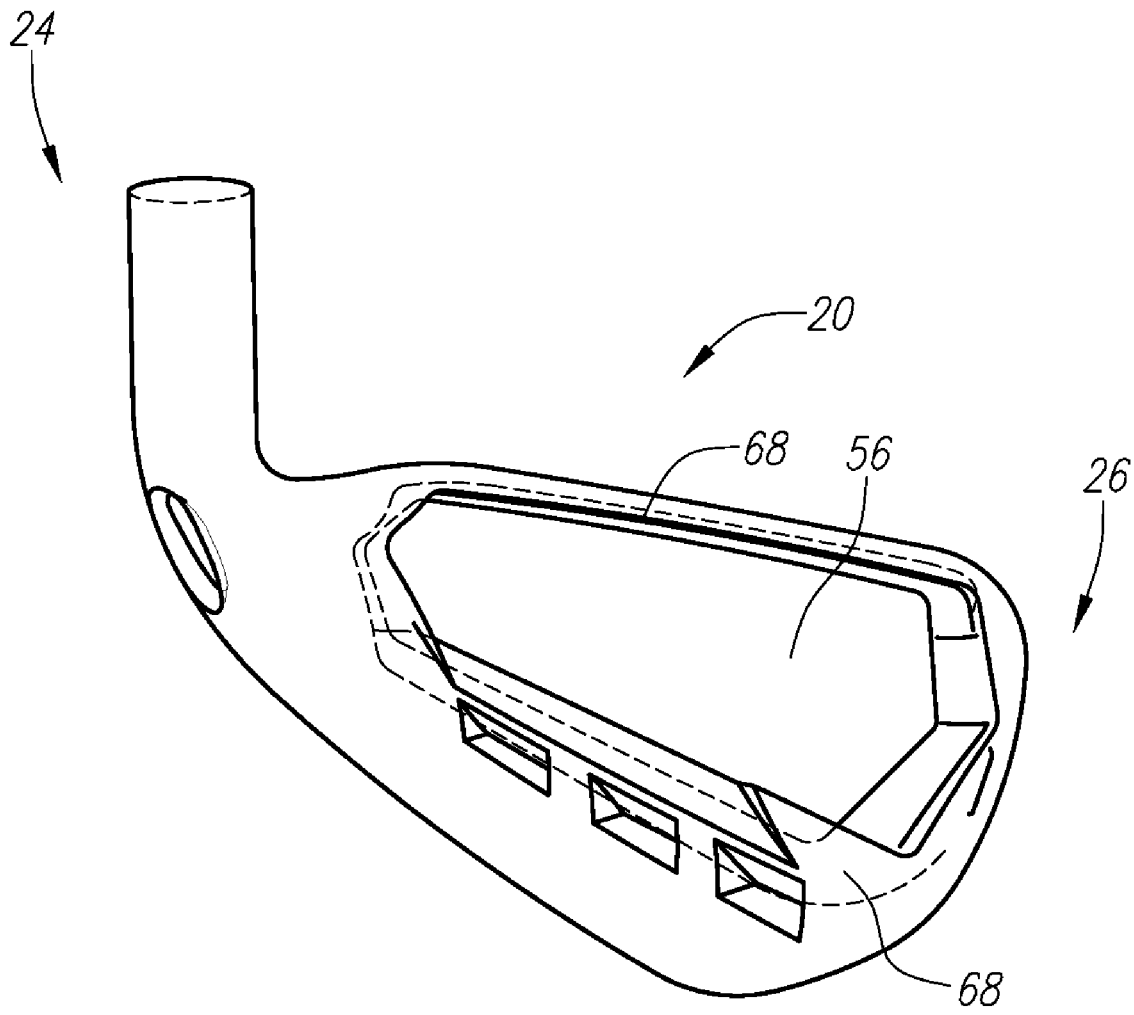
FIG. 6 is a bottom perspective view of an iron-type golf club head.
Figure 7:
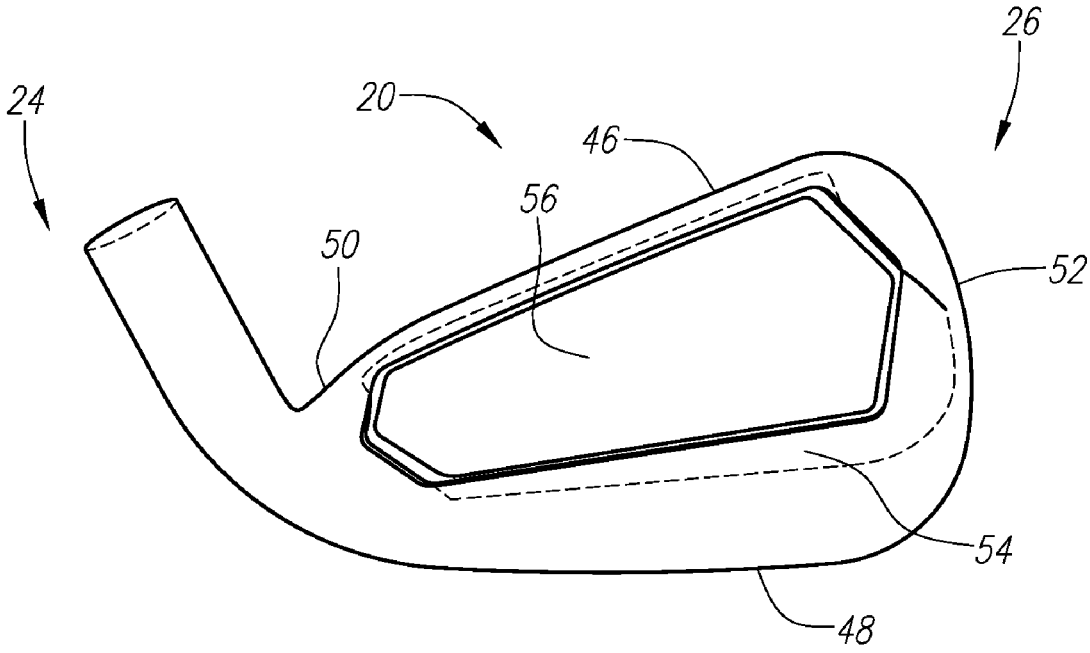
FIG. 7 is rear view of an iron-type golf club head.
Figure 8:
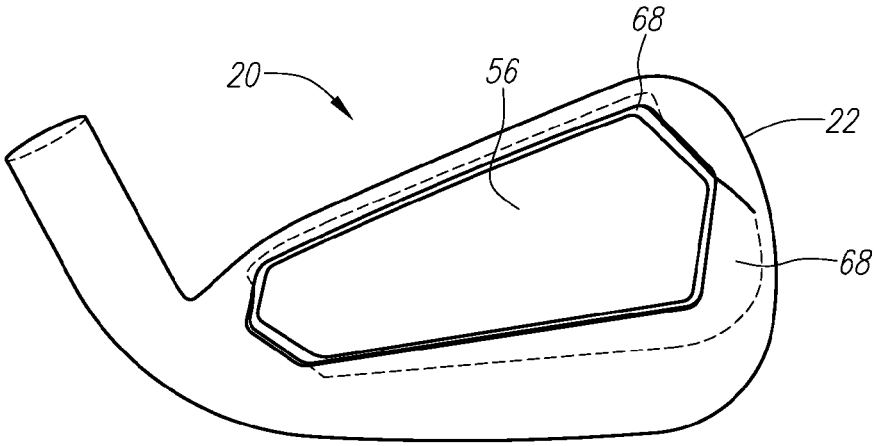
FIG. 8 is a rear view of an iron-type golf club head.
Figure 9:
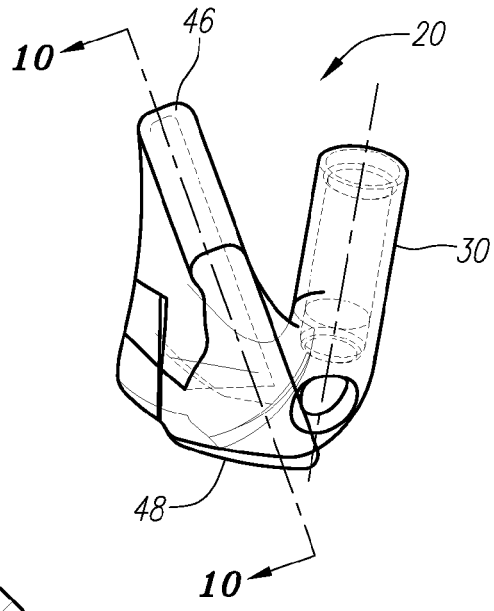
FIG. 9 is a side view of an iron-type golf club head illustrating interior portions.
Figure 10:
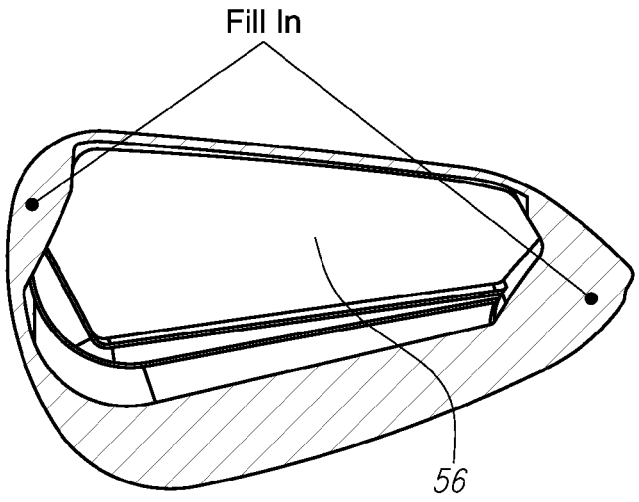
FIG. 10 is a cross-sectional view of along line A-A of FIG. 9.
Figure 11:
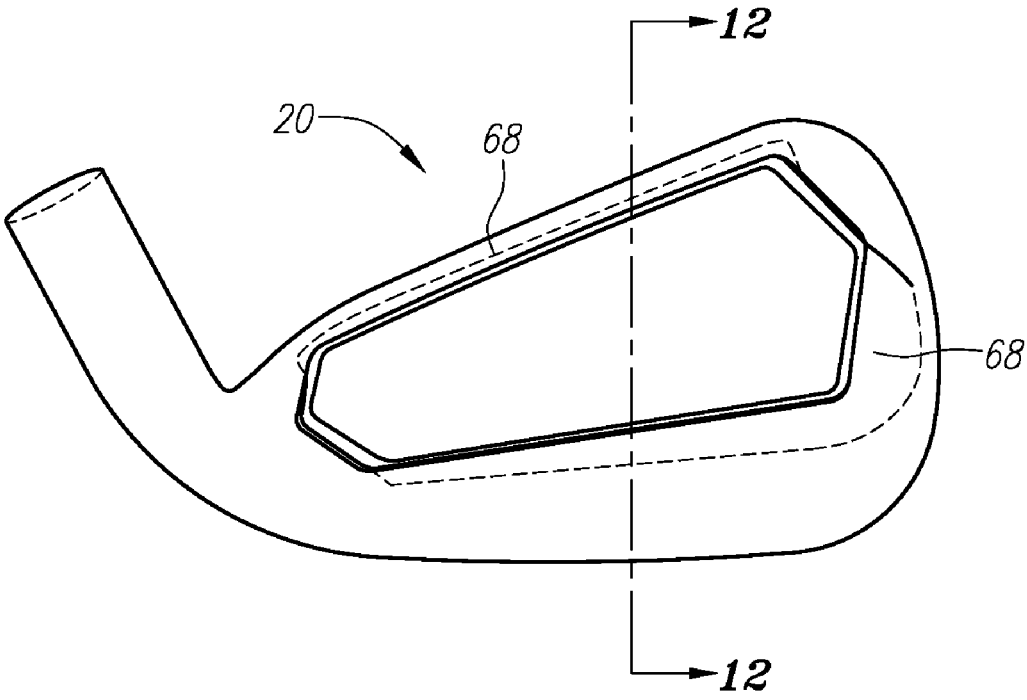
FIG. 11 is a rear view of an iron-type golf club head.
Figure 12:
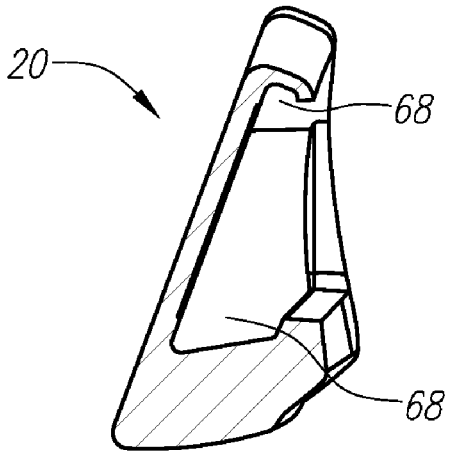
FIG. 12 is a cross-sectional view of along line A-A of FIG. 11.
Figure 13:
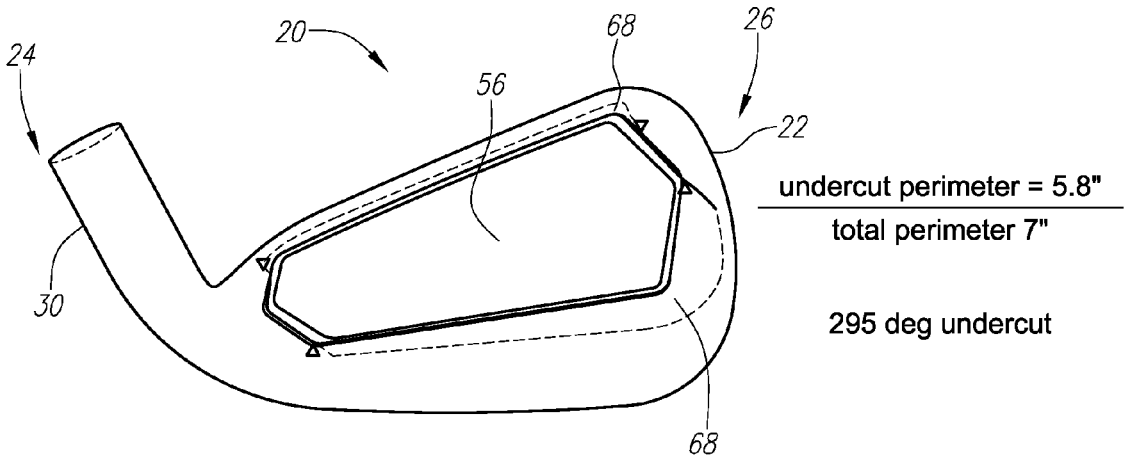
FIG. 13 a rear view of an iron-type golf club head illustrating a 295 degrees undercut portion in a rear cavity.
Figure 14:
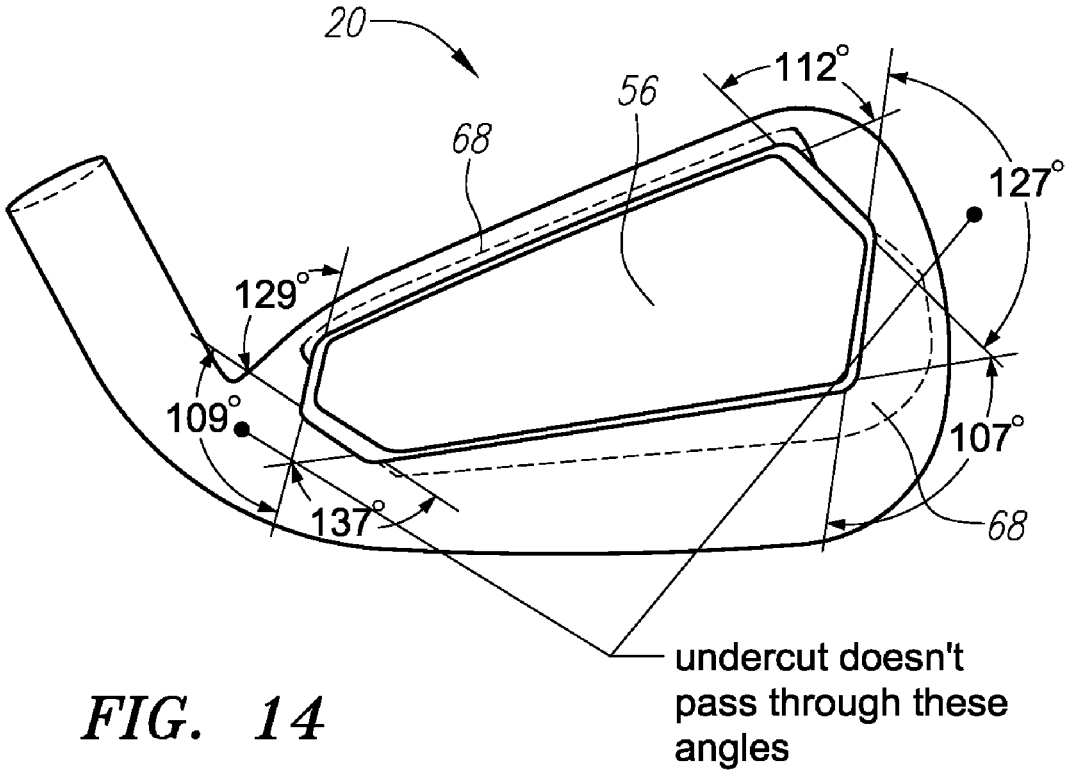
FIG. 14 a rear view of an iron-type golf club head illustrating an alternative means for determining an undercut portion in a rear cavity.
Figure 15:
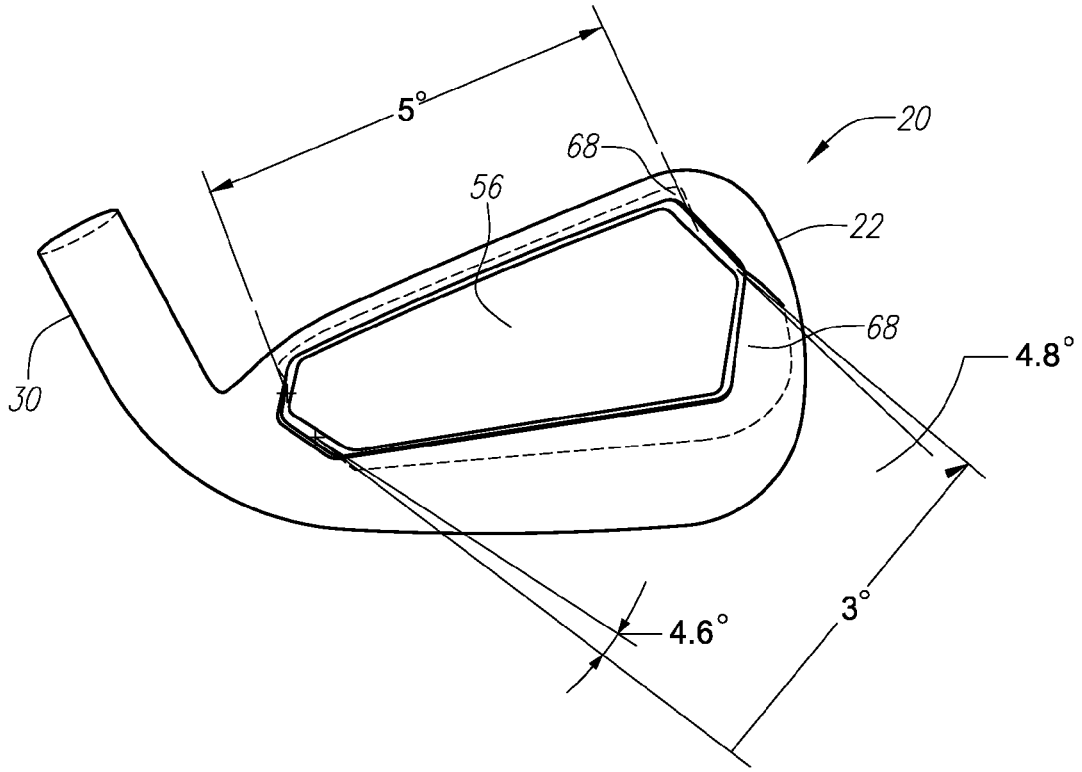
FIG. 15 a rear view of an iron-type golf club head illustrating an alternative means for determining an undercut portion in a rear cavity.
Figure 16:
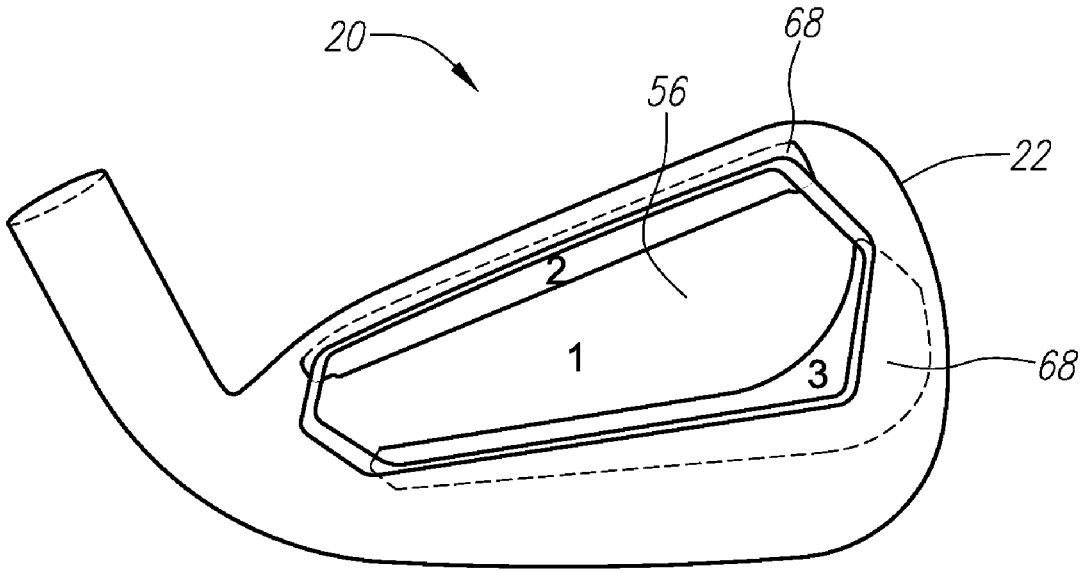
FIG. 16 a rear view of an iron-type golf club head illustrating an alternative means for determining an undercut portion in a rear cavity.

As shown in FIGS. 1-16, an iron-type golf club is generally designated 20. The golf club head 20 includes a body having a face with a surface and a rear cavity with an undercut portion. The body is preferably composed of a material such as titanium materials, stainless steel, carpenter steel, 1020 steel, amorphous metals and the like. The material of the body preferably has a density between 4 g/cm$^3$ and 10 g/cm$^3$. Such titanium materials include pure titanium and titanium alloys such as 6-4 titanium alloy, 6-22-22 titanium alloy, 4-2 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. The body 21 is preferably manufactured through casting. Alternatively, the body 21 is manufactured through forging, forming, machining, powdered metal forming, metal-injection-molding, electro-chemical milling, and the like.

As shown in FIGS. 1-16, an iron-type golf club head in accordance with the present invention is generally designated 20. The club head 20 is a cavity-back iron and includes a body 22 having a heel end 24 and a toe end 26. The body 22 has a front wall 28 for contacting a golf ball and a hosel 30 for receiving a shaft, not shown. In a preferred embodiment the golf club head 20 is composed of a stainless steel, however, those of ordinary skill in the art will appreciate that the golf club head 20 may also be composed of other materials, such as carbon steel, titanium, titanium alloy, zirconium or zirconium alloy.

The front wall 28 of golf club head 20 has a ball-striking surface 40 and a back surface 42. The ball-striking surface 40 has a plurality of scorelines 44 formed therein. In a preferred embodiment the top of the hosel 30 is lower than the toe end of the front wall 28, thereby lowering the center of gravity of the club head 20.

The golf club head 20 also has a top portion 46, a sole portion 48, a heel portion 50, a toe portion 52 and a rear surface 54. The top wall 46 extends rearward from the top end of the front wall 28, in a direction opposite the ball-striking surface 40, to the rear surface 54 of the body 22. The sole portion 48 extends rearward from the bottom end of the front wall 28 to the rear surface 54. The heel portion 50 extends rearward from the heel end 24 of the front wall 28 to the rear surface 54, and the toe portion 52 extends rearward from the toe end 26 of the front wall 28 to the rear surface 54. The rear surface 54, the top portion 46, the sole portion 48, the heel portion 50 and the toe portion 52 define an external rear cavity 56 in the body 22 of the club head 20. The top portion 46, the sole portion 48, the heel portion 50 and the toe portion 52 also provide the club head 20 with perimeter weighting to make the club head more forgiving and provide better performance for the typical golfer.

The golf club head 20 preferably includes an undercut recess 68 in communication with the external rear cavity 56. The undercut recess 68 preferably circumscribes the external rear cavity 56. Alternatively, the undercut recess 68 may extend along only a portion of the external rear cavity 56. A medallion, not shown, is preferably disposed in the external rear cavity 56 of the body 22.

As shown in FIGS. 1-16, the present invention creates a geometry that is aesthetically pleasing, consistent with the best mass properties and accommodating to the golfers interest in sole shapes that minimize interference between the turf and club head. This is accommodated by combining features of better player clubs and with improving player clubs. The radius of the face to sole transition is designed to be a smaller radius to maximize the extension of the flat face within the ball contact locations. Also the radius design penetrated the turf better than a more blunt face to sole transition.

Alternatively, the structure of the iron-type golf club is such as disclosed in Helmstetter, et al., U.S. Pat. No. 5,776,010, which is hereby incorporated by reference in its entirety.

Alternatively, the structure of the iron-type golf club is such as disclosed in Schmidt, et al., U.S. Pat. No. 5,749,795, which is hereby incorporated by reference in its entirety.

Alternatively, the structure of the iron-type golf club is such as disclosed in Schmidt, et al., U.S. Pat. No. 5,704,849, which is hereby incorporated by reference in its entirety Alternatively, the structure of the iron-type golf club is such as disclosed in Blough et al., U.S. Pat. No. 5,921,869, which is hereby incorporated by reference in its entirety.

Alternatively, the structure of the iron-type golf club is such as disclosed in Kosmatka, U.S. Pat. No. 5,971,868, which is hereby incorporated by reference in its entirety.

Alternatively, the structure of the iron-type golf club is such as disclosed in Kosmatka, U.S. Pat. No. 6,045,455, which is hereby incorporated by reference in its entirety.

Alternatively, the structure of the iron-type golf club is such as disclosed in Kosmatka, U.S. Pat. No. 6,186,905, which is hereby incorporated by reference in its entirety.

Alternatively, the structure of the iron-type golf club is such as disclosed in Erickson, et al., U.S. Pat. No. 6,210,290, which is hereby incorporated by reference in its entirety.

Alternatively, the structure of the iron-type golf club is such as disclosed in Reyes, et al., U.S. Pat. No. 7,144,336, which is hereby incorporated by reference in its entirety.

Alternatively, the structure of the iron-type golf club is such as disclosed in Deshmukh, U.S. Pat. No. 7,112,148, which is hereby incorporated by reference in its entirety.

Alternatively, the structure of the iron-type golf club is such as disclosed in Aguinaldo, et al., U.S. Pat. No. 7,083,531, which is hereby incorporated by reference in its entirety.

Alternatively, the structure of the iron-type golf club is such as disclosed in Wieland, et al., U.S. Pat. No. 7,338,389, which is hereby incorporated by reference in its entirety.

Alternatively, the structure of the iron-type golf club is such as disclosed in Nycum, et al., U.S. Pat. No. 7,338,387, which is hereby incorporated by reference in its entirety.

Alternatively, the structure of the iron-type golf club is such as disclosed in Holt, et al., U.S. Pat. No. 7,326,126, which is hereby incorporated by reference in its entirety From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. An iron-type golf club head comprising:

a body having a rear cavity with a non-continuous undercut portion wherein a total perimeter of the rear cavity is segmented into six straight sections, and wherein a portion of a toe side of the rear cavity between a bottom side and a top side of the rear cavity has an undercut portion.

2. The iron-type golf club head according to claim 1 wherein the body further comprises a sharp angle undercut portion.

3. The iron-type golf club head according to claim 1 wherein the body further comprises a non-curved undercut portion.

4. The iron-type golf club head according to claim 1 wherein at least five sections of the six sections have an undercut portion.

5. The iron-type golf club head according to claim 1 wherein at least four sections of the six sections have an undercut portion.

6. The iron-type golf club head according to claim 1 wherein the body is composed of stainless steel, titanium alloy, carpenter steel, or any combination thereof.

7. An iron-type golf club head comprising:

a body having a rear cavity with an undercut portion of 295 degrees, wherein a total perimeter of a rear cavity is 7.8 inches and an undercut portion is present along 5.8 inches of the total perimeter.

* * * * *